US008720799B2

(12) United States Patent
Tseng

(10) Patent No.: US 8,720,799 B2
(45) Date of Patent: May 13, 2014

(54) SHOWER HEAD HANGER

(76) Inventor: Huei-Chun Tseng, New Taipei (TW)

( * ) Notice: Subject to any disclaimer, the term of this patent is extended or adjusted under 35 U.S.C. 154(b) by 269 days.

(21) Appl. No.: 13/334,052

(22) Filed: Dec. 22, 2011

(65) Prior Publication Data

US 2013/0161420 A1 Jun. 27, 2013

(51) Int. Cl.

| | |
|---|---|
| ***B05B 15/06*** | (2006.01) |
| ***B05B 1/30*** | (2006.01) |
| ***A62C 31/00*** | (2006.01) |
| ***E03C 1/042*** | (2006.01) |

(52) U.S. Cl.
USPC ..... 239/443; 239/282; 239/446; 239/447; 239/581.1; 4/695

(58) Field of Classification Search
USPC ..... 4/695; 239/443, 446–447, 569, 581.1, 239/282, 565
See application file for complete search history.

(56) References Cited

U.S. PATENT DOCUMENTS

| | | | | |
|---|---|---|---|---|
| 6,622,945 | B1 * | 9/2003 | Wu et al. | 239/443 |
| 8,020,787 | B2 * | 9/2011 | Leber et al. | 239/447 |
| 8,028,935 | B2 * | 10/2011 | Leber | 239/436 |
| 2006/0138253 | A1 * | 6/2006 | Petrovic et al. | 239/446 |
| 2007/0272770 | A1 * | 11/2007 | Leber et al. | 239/451 |
| 2009/0007330 | A1 * | 1/2009 | Genord et al. | 4/695 |

* cited by examiner

*Primary Examiner* — Ryan Reis

(57) ABSTRACT

A shower head hanger includes a three-way pipe, a bracket, a face lid, and a rotation valve. The three-way pipe has a rear end which is fixed to a wall. The three-way pipe has a lower end which is connected with a shower head through a tube. The three-way pipe has a front end which is in a forked shape to receive the bracket therein. The shower head is hanged on the bracket. The face lid is located at the front end of the three-way pipe. The three-way pipe has a side wall formed with a valve hole to receive the rotation valve which is used to control communication of the rear end, the front end and the lower end. The shower head hanger of the present invention provides a multi-outflow function for the user to take a shower in a different way.

2 Claims, 8 Drawing Sheets

SHOWER HEAD HANGER

BACKGROUND OF THE INVENTION

1. Field of the Invention

The present invention relates to a shower head hanger, and more particularly to a shower head hanger which has a water outflow function.

2. Description of the Prior Art

There are two types of shower head hangers on the market. One is fixed on the wall for the shower head to be hanged thereon without a water outflow function, and the other is as shown in FIG. 1 through FIG. 3. The shower head hanger is to combine a bracket 10 and a two-way pipe 20. The upper end of the two-way pipe 20 is threadedly connected to a spherical head nut 30. The spherical head nut 30 is fitted on a spherical head 60. A fixing ring 40 and a washer 50 are provided between the spherical head nut 30 and the inner side of the upper end of the two-way pipe 20. The spherical head 60 is fixed on the wall, so that the shower head hanger is also fixed on the wall. The lower end of the two-way pipe 20 is connected with a shower head through a tube so as to supply water to the shower head. The bracket 10 is for the shower head to be hanged thereon. In order to position the shower head well, the inner wall of the bracket 10 is provided with a skidproof pad 70. The spherical head 60 comprises a seal washer 80 therein.

But, the aforesaid two shower head hangers cannot achieve a water outflow function and are unable to enhance their functions to satisfy consumers for more demands. Accordingly, the inventor of the present invention has devoted himself based on his many years of practical experiences to solve these problems.

SUMMARY OF THE INVENTION

The primary object of the present invention is to provide a shower head hanger which can be used for suspension of a shower head and used as a shower head to spray water from the side.

In order to achieve the aforesaid object, the shower head hanger of the present invention comprises a three-way pipe, a bracket, a face lid, and a rotation valve. The three-way pipe has a rear end which is fixed to a wall. The three-way pipe has a lower end which is connected with a shower head through a tube. The three-way pipe has a front end which is in a forked shape to receive the bracket therein. The shower head is hanged on the bracket. The face lid is located at the front end of the three-way pipe. The three-way pipe has a side wall formed with a valve hole to receive the rotation valve which is used to control communication of the rear end, the front end and the lower end.

Preferably, the rear end of the three-way pipe is threadedly connected to a spherical head nut. The spherical head nut is fitted on a spherical head. The spherical head is fixed on the wall.

Preferably, a fixing ring and a washer are provided among the spherical head nut and an inner side of the rear end of the three-way pipe and the spherical head.

Preferably, the rotation valve comprises a sleeve, a valve core unit, a rotation support and a switch knob. The sleeve is disposed in the three-way pipe. The valve core unit is mounted in the sleeve. The rotation support is mounted in the valve hole. The valve core unit has a switch end which is inserted through the rotation support and fixed to the switch knob. The switch knob is located out of the valve hole of the three-way pipe.

The present invention uses the three-way pipe instead of the two-way pipe and adds the rotation valve, such that the rear end of the three-way pipe can selectively communicate with the front end and/or the lower end.

When the rear end only communicates with the lower end, the shower head hanger of the present invention like the conventional shower head hanger supplies water to the shower head hanged on the bracket.

When the rear end only communicates with the front end, the water flows out from the face lid of the shower head hanger of the present invention like a shower head to spray water from the side.

When the rear end communicates with the lower end and the front end, the water flows out through the shower head hanged on the bracket to spray water from the top and through the face lid to spray water from the side. The user can take a shower in a multi-direction way to save water and time.

Thus, the shower head hanger of the present invention provides a multi-outflow function for the user to take a shower in a different way.

DETAILED DESCRIPTION OF THE PREFERRED EMBODIMENTS

Embodiments of the present invention will now be described, by way of example only, with reference to the accompanying drawings.

Figure 1:
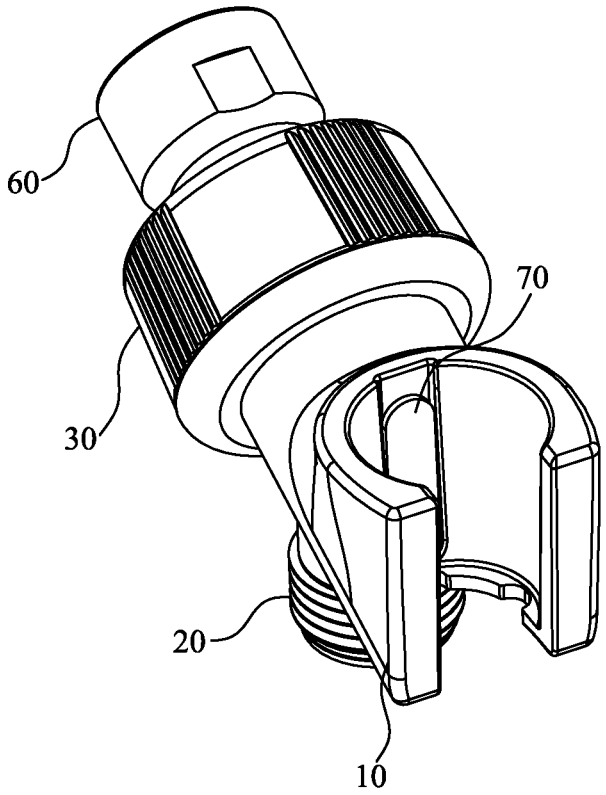
FIG. 1 Prior Art
FIG. 1 is a perspective view of a conventional shower head hanger.
Figure 2:
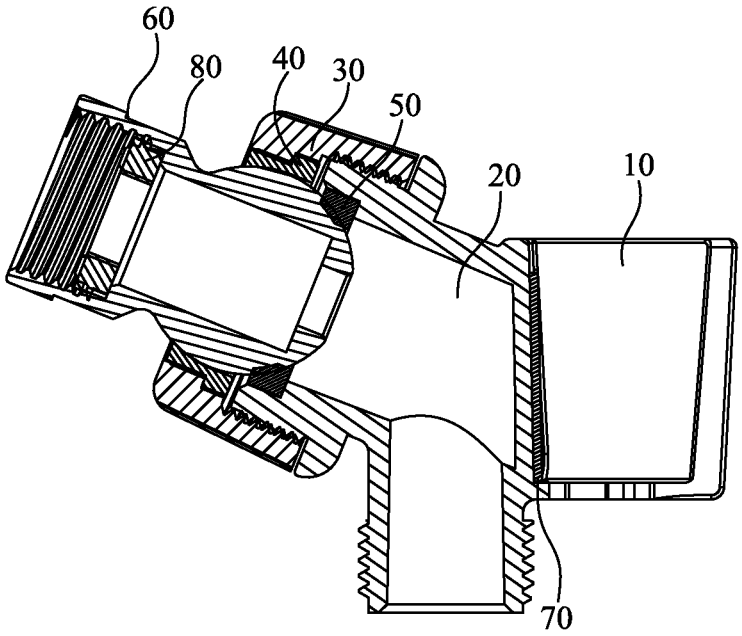
F I G. 2 Prior Art
FIG. 2 is a sectional view of the conventional shower head hanger.
Figure 3:
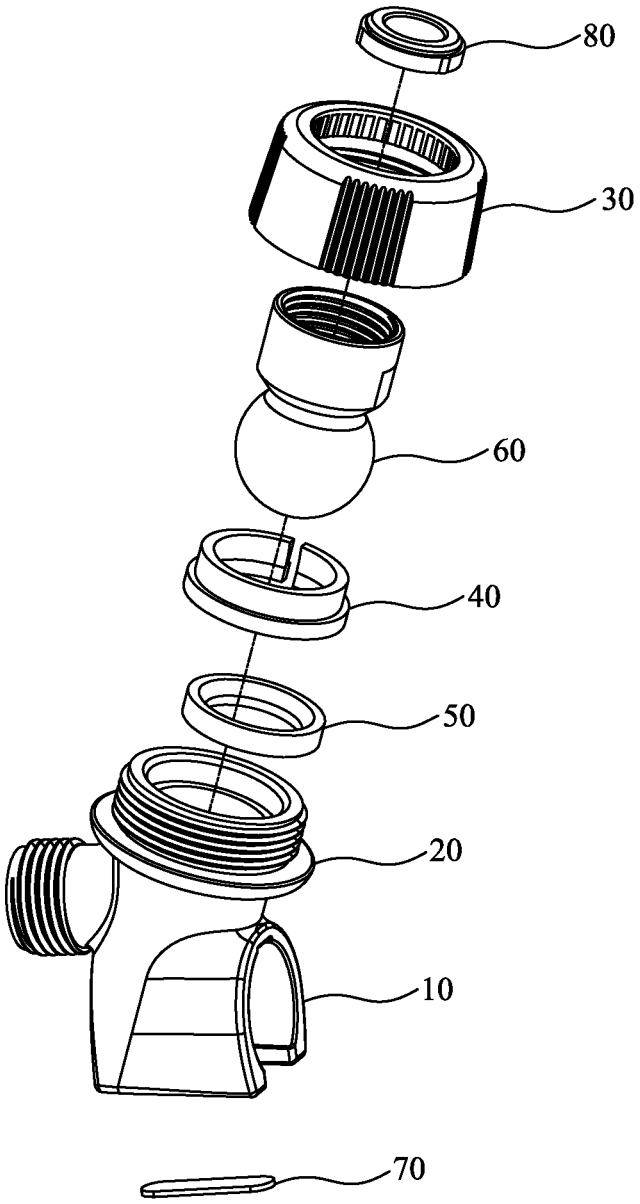
FIG. 3 Prior Art
FIG. 3 is an exploded view of the conventional shower head hanger.
Figure 4:
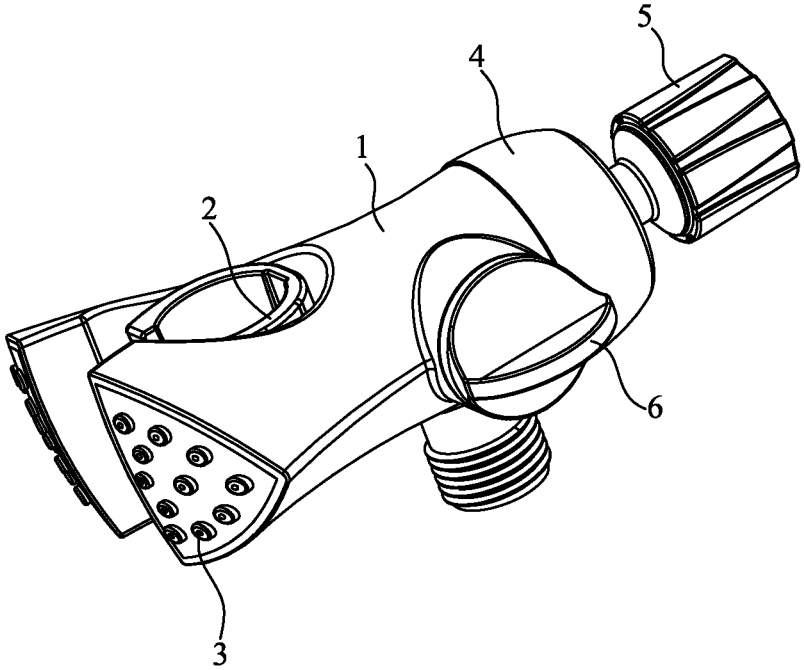
FIG. 4 is a perspective view according to a preferred embodiment of the present invention.
Figure 5:
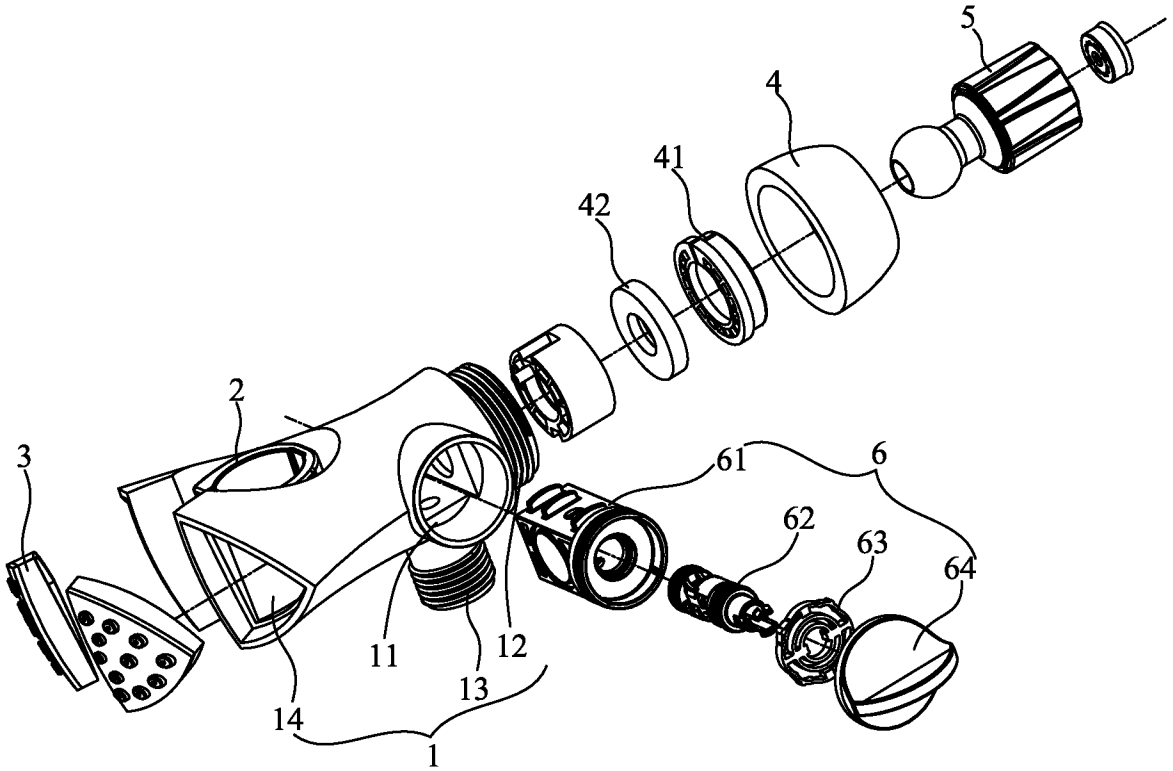
FIG. 5 is an exploded view according to the preferred embodiment of the present invention.
Figure 6:
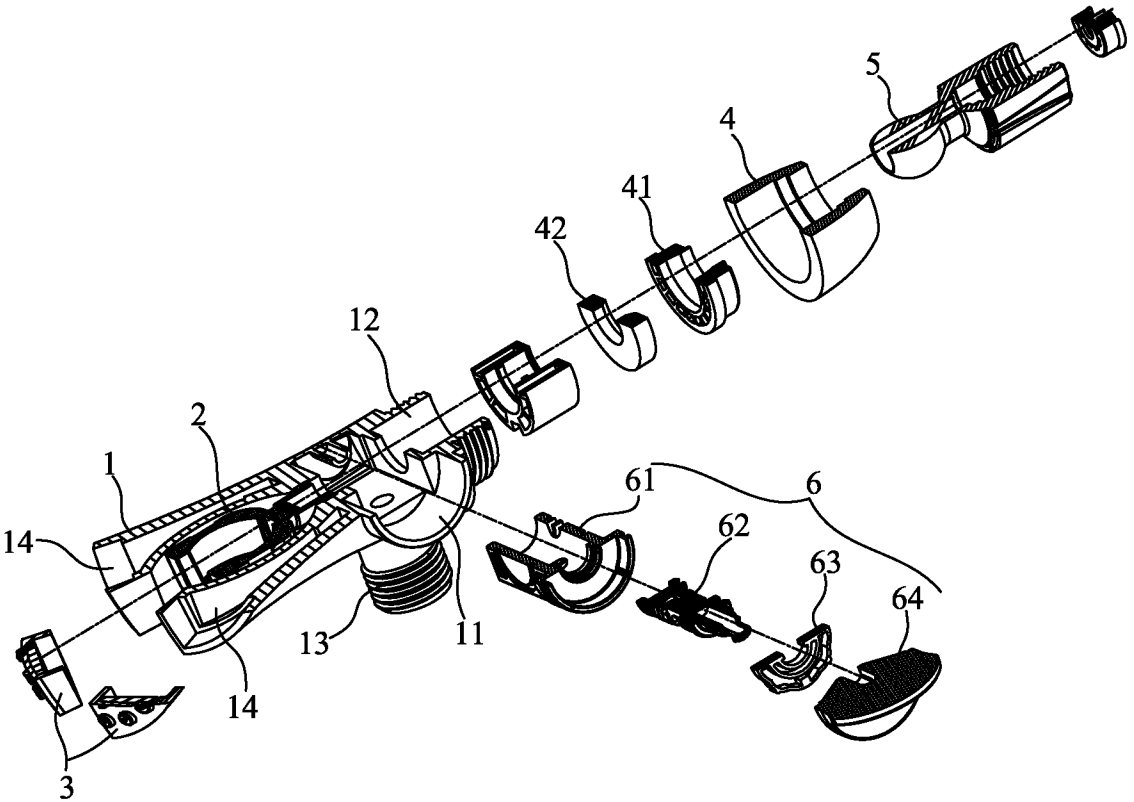
FIG. 6 is an exploded and sectional view according to the preferred embodiment of the present invention.
Figure 7:
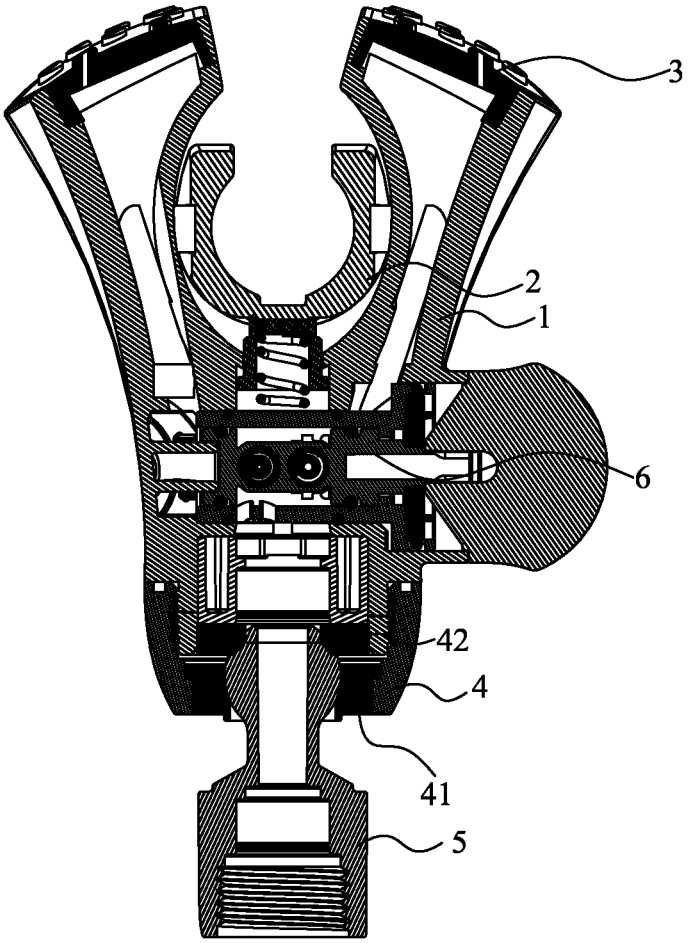
FIG. 7 is a top sectional view according to the preferred embodiment of the present invention.

As shown in FIG. 4 and FIG. 7, the shower head hanger according to a preferred embodiment of the present invention comprises a three-way pipe 1, a bracket 2, a face lid 3, a spherical head nut 4, a spherical head 5, and a rotation valve 6.

Figure 8:
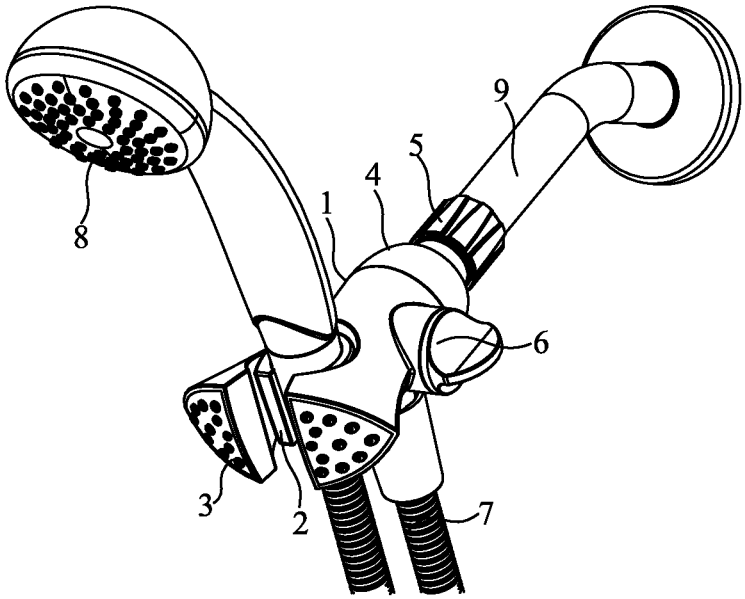
FIG. 8 is a schematic of the preferred embodiment of the present invention when in use.

The three-way pipe 1 has a rear end 12 which can be directly fixed to a wall or indirectly fixed to the wall by other parts. As shown in the drawings, the rear end 12 of the three-way pipe 1 is threadedly connected to the spherical head nut 4. The spherical head nut 4 is fitted on the spherical head 5 to ensure water seal. A fixing ring 41 and a washer 42 are provided among the spherical head nut 4 and the inner side of the rear end 12 of the three-way pipe 1 and the spherical head 5. The spherical head 5 is fixed on the wall. As shown in FIG. 8, the spherical head 5 is connected to a wall-mounted pipe 9. The spherical head 5 comprises a seal washer (not numbered in the drawings) therein.

The three-way pipe 1 has a lower end 13 which is connected with a shower head 8 through a tube 7.

The feature of the present invention is that the three-way pipe 1 has a front end 14 which is in a forked shape to receive the bracket 2 therein. The shower head 8 can be hanged on the bracket 2. The face lid 3 is located at the front end 14 of the three-way pipe 1 for water outflow. The three-way pipe 1 has a side wall formed with a valve hole 11 to receive the rotation valve 6 which is used to control communication of the rear end 12, the front end 14 and the lower end 13. The rotation valve 6 may adopt the existing parts. As shown in the drawings, the rotation valve 6 comprises a sleeve 61, a valve core unit 62, a rotation support 63, and a switch knob 64. The sleeve 61 is disposed in the three-way pipe 1. The valve core unit 62 is mounted in the sleeve 61. The rotation support 63 is mounted in the valve hole 11. The valve core unit 62 has a switch end which is inserted through the rotation support 63 and fixed to the switch knob 64. The switch knob 64 is located out of the valve hole 11 of the three-way pipe 1 for switch operation. The rear end 12 of the three-way pipe 1 can selectively communicate with the front end 14 and/or the lower end 13.

When the present invention is in use, there are three types of use by switching the rotation valve 6.

When the rear end 12 only communicates with the lower end 13, the shower head hanger of the present invention like the conventional shower head hanger supplies water to the shower head 8 hanged on the bracket 2.

When the rear end 12 only communicates with the front end 14, the water flows out from the face lid 3 of the shower head hanger of the present invention like a shower head to spray water from the side.

When the rear end 12 communicates with the lower end 13 and the front end 14, the water flows out through the shower head 8 hanged on the bracket 2 to spray water from the top and through the face lid 3 to spray water from the side. The user can take a shower in a multi-direction way to save water and time.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head hanger, comprising a three-way pipe, a bracket, a face lid, and a rotation valve; the three-way pipe having a rear end which is fixed to a wall, the three-way pipe having a lower end which is connected with a shower head through a tube, and a front end which is in a forked shape concentrically oriented with the bracket to rotatably receive the bracket therein, the shower head being hanged on the bracket in an adjustable position thereon, the face lid being located at the front end of the three-way pipe facing sideways, parallelly oriented to the three-way pipe and perpendicularly oriented to the rotation valve in a position the shower head and the face lid are not disposed on a same plane, the three-way pipe having a side wall formed with a valve hole to receive the rotation valve which is used to control communication of the rear end, the front end and the lower end, wherein i) when the rear end communicates exclusively with the lower end, the shower head hanger supplies water to the shower head, ii) when the rear end communicates exclusively with the front end, the water flows out from the two face lids of the shower head hanger to spray water from a side thereof, and iii) when the rear end communicates at the same time with both the lower end and the front end, the water flows out through the shower head to spray water from a top and through the face lid from the two sides thereof.

2. The shower head hanger as claimed in claim 1, wherein the rear end of the three-way pipe is threadedly connected to a spherical head nut, the spherical head nut is fitted on a spherical head, and the spherical head is fixed on the wall.

* * * * *